US006834985B2

(12) United States Patent
Chou et al.

(10) Patent No.: US 6,834,985 B2
(45) Date of Patent: Dec. 28, 2004

(54) COOLING APPARATUS FOR ILLUMINATION SYSTEM

(75) Inventors: Bor-Bin Chou, Hsin-Chu (TW); Kuan-Chou Ko, Hsin-Chu (TW)

(73) Assignee: Coretronic Corporation, Hsin-Chu (TW)

( * ) Notice: Subject to any disclaimer, the term of this patent is extended or adjusted under 35 U.S.C. 154(b) by 0 days.

(21) Appl. No.: 10/065,953

(22) Filed: Dec. 4, 2002

(65) Prior Publication Data

US 2003/0107897 A1 Jun. 12, 2003

(30) Foreign Application Priority Data

Dec. 6, 2001 (TW) ..... 90221495 U

(51) Int. Cl.[7] ..... F21V 29/02
(52) U.S. Cl. ..... 362/373; 362/294; 353/61
(58) Field of Search ..... 362/294, 373, 362/264; 353/57, 61

(56) References Cited

U.S. PATENT DOCUMENTS 5,497,573 A * 3/1996 Stadjuhar et al. ..... 40/564
6,132,049 A * 10/2000 Yamaguchi et al. ..... 353/61
6,139,155 A * 10/2000 Takizawa ..... 353/57
6,283,614 B1 * 9/2001 Okada et al. ..... 362/294
6,340,237 B1 * 1/2002 Koga et al. ..... 362/294
6,431,710 B2 * 8/2002 Fuse et al. ..... 353/57
6,783,245 B2 * 8/2004 Konuma et al. ..... 353/61

* cited by examiner

*Primary Examiner*—Y. My Quach-Lee
*Assistant Examiner*—Peggy A. Neils
(74) *Attorney, Agent, or Firm*—Winston Hsu

(57) ABSTRACT

The cooling apparatus for illumination system of optical engine of the present invention includes: illumination system that has a lamp base for its light source, wherein the lamp has an air duct body fixed on one side of the lamp base, wherein there is at least one partition separating the air duct body into a plurality of air ducts of different surface areas, and an external air duct extending one of the air ducts from underneath the air duct body to outside of the air duct body, wherein a fan installed on the air duct body takes in air through each of the air ducts and the external air duct to cool the illumination system, thus improving the cooling efficiency of the fans, while reducing the volume of cooling air needed from the fans, lowering the cost and reducing the noise from the fans.

6 Claims, 4 Drawing Sheets

COOLING APPARATUS FOR ILLUMINATION SYSTEM

BACKGROUND OF INVENTION

1. Field of the Invention

The present invention relates to a projection display, and more particularly, to an illumination system of optical engine for projection display, and specifically, to a cooling apparatus of illumination optical engine for projection display.

2. Description of the Prior Art

With the rapid development of optical electronic technologies, conventional projection display apparatus usually uses a high power light bulb as the light source for illumination system in order to have a brighter and clearer image on the screen and provide a comfortable view environment to users. However, the high power light bulb creates the problem of high heat dispersion temperature in the mean while. In order to cool the heat generated by the high power light bulb and the optical components of the illumination system, and further avoid the optical components from deteriorating due to the high temperature. The illumination system of optical engine in the prior art projection display uses fans for the cooling. However, due to the fact that the light bulbs and optical components that require cooling are widely spread out, multiple cooling fans have to be installed, and causing a noise problem with noise. Therefore, the way of effectively dispersing heat and reducing noise becomes an important research and development subject for the projection display industry.

As illustrated in FIG. 1, the optical engine of the projection display apparatus of the prior art mainly consist of an illumination system 10 and an imaging system 20, wherein the illumination system 10 has a light bulb as the light source 11 installed inside the lamp base 111 for projecting a light beam, wherein the light beam projects into the first lens array 12 inside the lens framework 17. The first lens array 12 is composed of numerous micro-lenses, which produces uniform light beam, wherein the first lens array 12 facts the light source with its back surface, the back surface of the lens array 12 is coated with a layer of ultraviolet-infrared cutter (UV-IR cutter) 121 for filtering the invisible light beam. Therefore the amount of such useless and invisible ultraviolet, infrared light beams projecting into the optical projection system can be reduced, so as to prevent the temperature of the optical components from increasing. After passing through the first lens array 12, the light beam is diverted via the reflection mirror 13 positioned slantwise in front of the first lens array 12, then projected into a second lens array 14, wherein the second lens array 14 fronts the light source with its back surface, the back surface of the second lens array 14 is coated with a layer of ultraviolet-infrared cutter (UV-IR cutter) 141. The light beam is then passed through a polarizing convert system (PCS) 151 which contains a layer of polarizing film 151, and a condenser lens 16 for converging light beam, and projecting to an imaging system 20.

The imaging system 20 separates the light beam into red and other visible beams via a first dichroic mirror 21. Thered light beam is reflected by the first dichroic mirror 21 and passed onto the first reflection mirror 211, then passed through the first lens set 212 that is composed of retarder plate, liquid crystal displayey (LCD), and polarizer, and finally projected onto the X-prism 24. The other visible beams are directly passed through the first dichroic mirror 21, and projected onto the second dichroic mirror 22 for separating into light beams of blue and green colors. The blue light beam is reflected via the second dichroic mirror 22, projecting through the second lens set 221 that is composed of polarizer retarder plate, liquid crystal display (LCD), and polarizer, and finally projected onto the X-prism 24. The green light beam is directly projected through the second dichroic mirror 22, and passed through the third reflection mirror 222, the fourth reflection mirror 223 and the third lens set 224 that is composed of the retarder plate, the liquid crystal display (LCD), and the polarizer. Then project the green light onto the X-prism 24. The X-prism combines the red, blue and green light beams and projects on the screen (not shown in drawing) via a projection lens 25.

In the optical engine application of the prior art, where high power light bulbs are used as the light source for projection, apart from the high heat of the light bulb as the light source that needs to cool, the first lens array 12 that gets the projection first also experiences an increase in temperature, as it takes most heat energy. When the projection temperature raise to the limitation, due to the ultraviolet-infrared cutter (UV-IR cutter) 121 and the lens array 12 are made from different materials, and thus having different coefficients of expansion, the layer of ultraviolet-infrared cutter (UV-IR cutter) 121 and the lens array 12 will be stripped off forming an interstice and affects optical quality. In addition, the light beam received by the second lens array 14, despite having been filtered through the UV-IR cutter 121 on the first lens array 12, still carries a fairly large amount of heat energy from the visible light beams. The layer of UV-IR cutter 141 on the second lens array 14 will also be stripped off when the temperature raises to the limitation. This stripping problem also affects the polarizing film 151 of the polarization system 15. Furthermore, high temperature also affects the optical quality of all the optical components in the imaging system 20. However, since the characteristics of the present invention are limited to the illumination system 10, the cooling of the imaging system 20 is not described within the present invention, wherein the imaging system is not limited to the penetrated type of light valve system, and can also include the reflective type of light valve system.

In the projection display of the prior art, in order to lower the temperature of the illumination system, which installing cooling fans, respectively, at the locations of the light source 11, the first lens array 12, the second lens array 14, and the polarization systems 15. There are also some apparatus of the prior art using a larger cooling fan for cooling the light source 11 and the first lens array 12, at the same time, while using another smaller fan for cooling the second lens array 14 that is located farther away from the light source 11. Nevertheless, both of these two methods require the use of multiple sets of fans, not only increasing cost and noise, but also increasing the difficulty in system control, to such an extent that the it lowers the reliability of the system, while affecting the quality of the products.

SUMMARY OF INVENTION

The object of the present invention is to provide a cooling apparatus for illumination system of optical engine, wherein only one single fan is applied in order to reduce noise and lower cost, while improving the reliability of the system operation.

The other object of the present invention is to provide a cooling apparatus for illumination system of optical engine according to the required cooling air of each component to arrange differentiated interstice of the air duct to effectively utilize the air flow from fan and improving the cooling efficiency of the fan.

To achieve the above-mentioned objectives, cooling apparatus for illumination system on optical engine of the present invention includes: an illumination system that has a lamp base for its light source, wherein the lamp base has an air duct body fixed on one side of it, wherein at least one partition separates the air duct body into a plurality of air ducts of different surface areas, and an outer air duct extends one of the air ducts from underneath the air duct body to outside of the air duct body, wherein a fan installed on the air duct body takes in air through each of the air ducts and the outer air duct to cool the illumination system, thus improving the cooling efficiency of the fans, while reducing the volume of cooling air needed from the fans, lowering the cost and reducing the noise from the fans.

DETAILED DESCRIPTION

Figure 1:
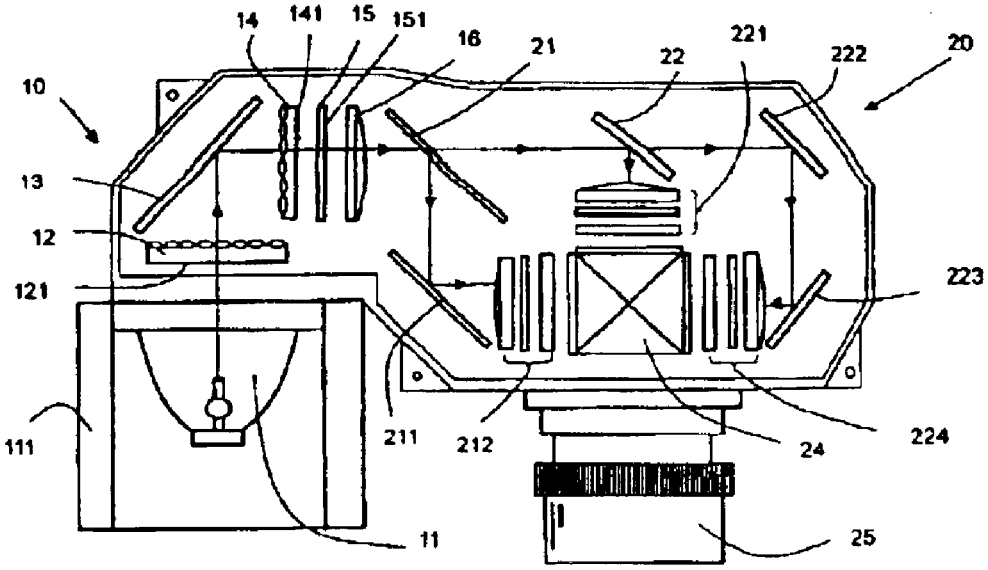
FIG. 1 (PRIOR ART)
FIG. 1 is a diagram illustrating the light path in the optical engine of the prior art.
Figure 2:
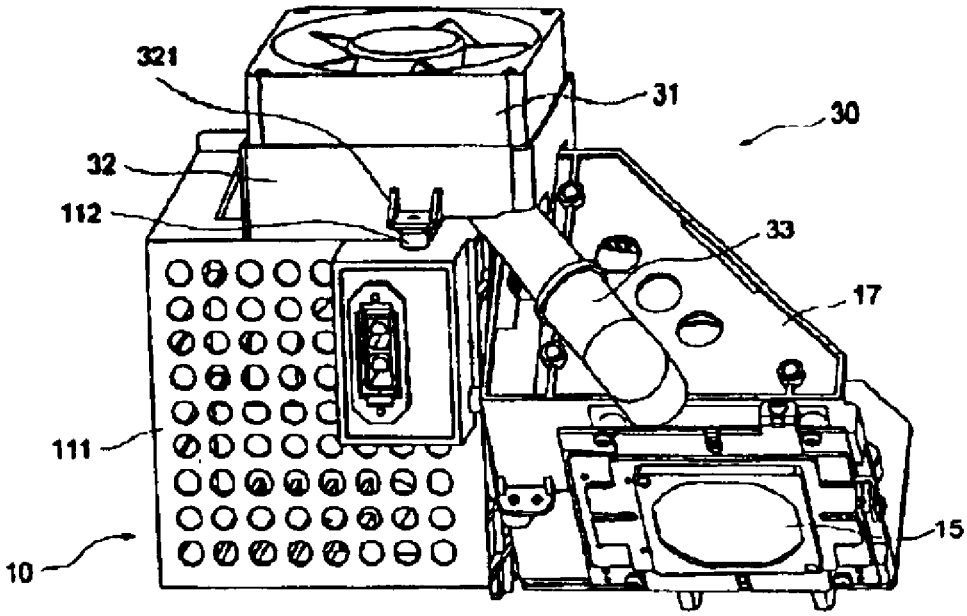
FIG. 2 is a perspective view illustrating the positional correlation between the cooling apparatus and the illumination system of the optical engine of the present invention.

Referring to the associated drawings, the embodiments of the present invention are now discussed in detail. Please refer to FIG. 2, which is a positional correlation between the cooling apparatus 30 and the optical engine 10 of the present invention, wherein the lens framework 17 in the illumination system is installed on the lamp base 111 at some angle, while the cooling apparatus 30 is fixed on one side of the lamp base 111, with some part of it crossing beyond the interface between the lamp base 111 and the lens framework 17, wherein a outer air duct 33 extends from one corner of the cooling apparatus 30 to the side of the exit of the lens framework 17.

Figure 3:
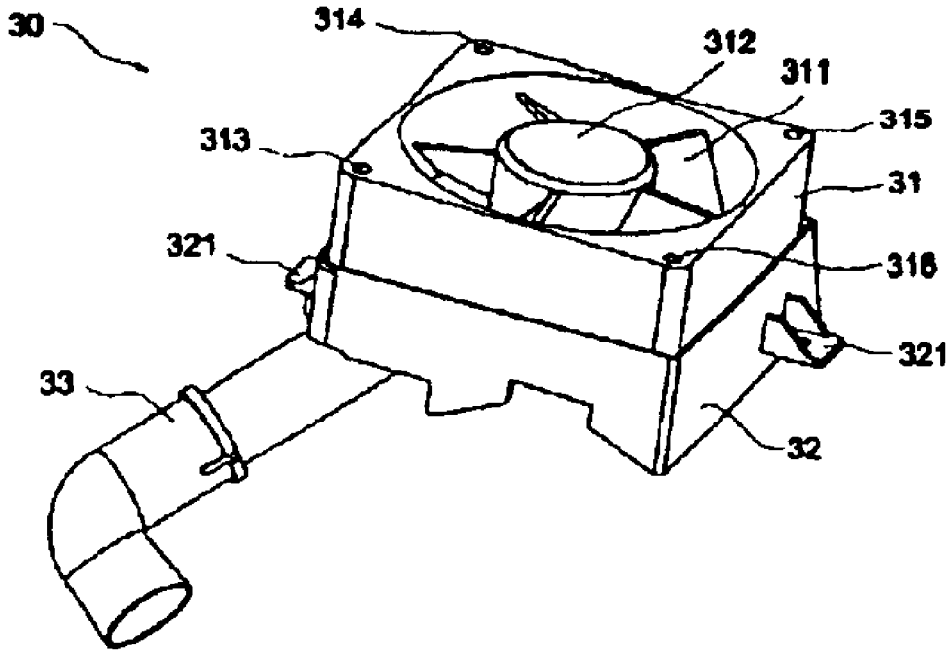
FIG. 3 is a perspective view illustrating the cooling apparatus of the present invention.

As shown in FIG. 3 the cooling apparatus 30 comprises a fan 31 and an air duct body 32. The air duct body 32 is a framed body with its cross-section resembling a square, wherein a fan 31, the shape of its cross-section being roughly the same as the air duct body 32 is installed on top opening of the air duct body 32. In the center of the fan 31 is a shaft 312 axial fan blades 311, while the four corners are set up with a pair of position holes 313, and 315, and a pair of fastening holes 314 and 316, respectively. The air duct body 32 has an external air duct 33 extending from one corners of the external air duct 33 unto near where the exit of the lens framework 17 is. Additionally, at locations corresponding to where the supporting frame 112 is located on the side of the lamp base 111, the air duct body 32 has a fixing base 321 set up on a pair sides of the air duct body 32, for fastening the supporting frame 112 onto the fixing base 321, thus fixing the cooling apparatus 30 onto the lamp base 111.

Figure 4:
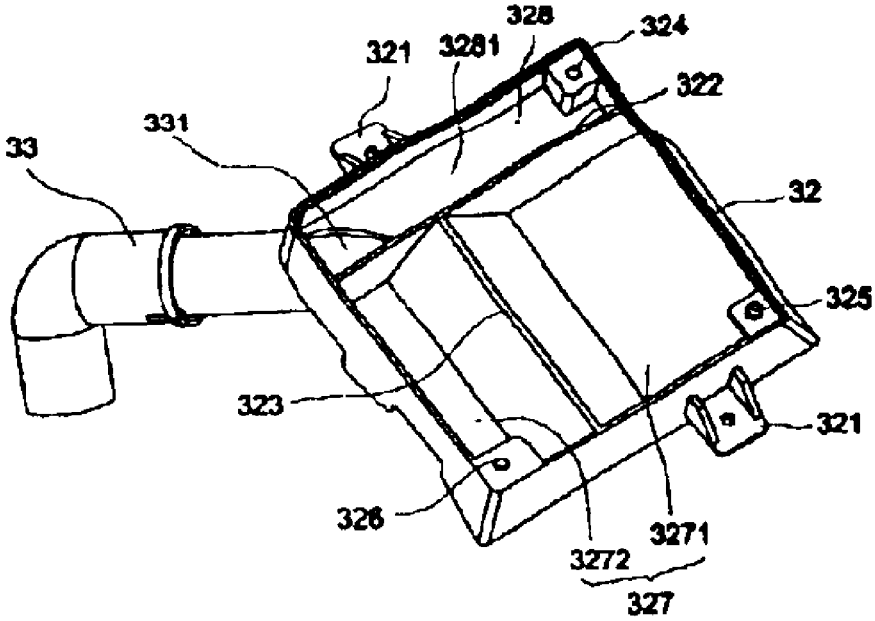
FIG. 4 is a perspective view illustrating the air duct structure of the present invention.

As shown in FIG. 4, the cross-section of the air duct body 32 is a framed body with its cross-section resembling a square. The air duct body 32 is separated into a main air duct 327 and an auxiliary air duct 328 by a main partition 322 spanning across the two sides of the air duct body 32. The surface area of the main air duct 327 is twice as large as that of the auxiliary air duct 328. Furthermore, the main air duct 327 is separated into a light source air duct 3271 and a lens air duct 3272 by a subsidiary partition 323 that spans across the main partition 322 and one side of the air duct body 32. The surface area of the light source air duct 3271 is three times as large as that of the lens air duct 3272. The auxiliary air duct 328 has a bottom plate 3281 sealing up the bottom side of auxiliary air duct 328, so as to gather the air flow to the air duct. An air guiding hole 331 is forming on one side of the bottom plate 3281, and a tubular external air duct 33 is jointed right underneath the air guiding hole 331. The external air duct 33 extends from underneath one corner of the air duct body 32 unto the second lens array 14 installed near the exit of the lens framework 17. Additionally, the four corners of the air duct body 32 are set up with a protruding position pin 325 at the corner located diagonally across from the external air duct 33, two fastening slots 324 and 326 are set up at the other two diagonal corners corresponding to the pair of position holes 313 and 315, and the pair of fastening holes 314 and 316 are set up on the four corners of the fan 31. By means of screws and bolts (not shown in drawing) inserted into the position holes 313 and 315, and fastened with fastening holes 324 and 326, the fan 31 can then be fixed onto the air duct body 32.

The present invention of the cooling apparatus for illumination system of optical engine uses a fan 31 to draw air from the outside, and blow into the air duct body 32 which is installed underneath the fan 31. The air duct body 32 guides the air to locations requiring cooling by the air ducts which are of different surface areas. The light source air duct 3271 guides most of the air into the light bulb as the light source 11 inside the lamp base 111, and the lens air duct 3272 guides part of the air, from the adjoining opening where the lamp base 111 and the lens framework 17 meet each other at the exit of the lens air duct 3272 to the illumination system 10, and then onto the first lens array 12 to cool. Furthermore, the auxiliary air duct 328 gathers the air into the air guiding hole 331 by the bottom plate 3281. The bottom plate 3281 guides the air flow into the external air duct 33, along with the guiding of the outer air duct 33, then unto where the exit of the lens framework 17 is, to cool the second lens array 14 and the polarization system 15 that are located farther along. Although the surface of the auxiliary air duct 328 is larger than the surface of the lens air duct 3272, the auxiliary air duct 328, is not carrying larger cooling air flow than the lens air duct 3272. The auxiliary air duct 328 has longer guiding distance and more turns of the flow direction, causing more loss in mobility than the lens air duct 3272. As the present invention of the cooling apparatus for illumination system of optical engine has taken into consideration the different amounts of cooling air needed by each location, the air duct body 32 is partitioned into air ducts of different surface areas, and an appropriate amount of air is respectively delivered to locations in need of cooling, thus allowing the amount of air coming out of the fan 31 to be fully utilized, while effectively improving the cooling efficiency of the fan. Therefore, with only one fan being applied, the cooling function of the illumination system can be fulfilled, while the amount of usage of the fan is reduced; not only does this save on cost, the noise of the fan is reduced, as well.

What is described above is to facilitate the description of the preferred embodiments of the present invention; the present invention is not limited to the above-mentioned embodiments. Any variations made according to the invention in any way to the details of the present invention may be possible as needed without departing from the scope of the invention. Additionally, the cooling apparatus of the present invention partitions an air duct body into air ducts of different surface areas. This helps to improve the cooling efficiency of the fan and reduce the amount of fan usage, not only saving on cost but also reducing the amount of noise produced by the fan.

It should be noted that the above-mentioned embodiments illustrate rather than limit than limit the invention, and that those skilled in the art will be able to design many alternative solutions without departing from the scope of the claims.

What is claimed is:

1. A cooling apparatus for an illumination system of an optical engine, the illumination system comprising a light source and a lamp base for the light source and having a side, the cooling apparatus comprising:

an air duct body having a top opening, a bottom opening, and an interior between the top opening and the bottom opening wherein the bottom opening is attached on the side of the lamp base;

at least one partition located in the interior of the air duct body and separating the air duct body into a pluraity of air ducts;

an external air duct connected to one of the plural plurality of air ducts at the bottom opening of the air duct body and extends to outside of the air duct body; and a fan attached on the top opening of the air duct body.

2. The cooling apparatus as claimed in claim 1, wherein the plurality of air ducts comprise a light source air duct, a lens air duct, and an auxiliary air duct, each of the plurality of air ducts has a different cross-section area.

3. The cooling apparatus as claimed in claim 2, wherein the lamp base has an exit, connected to an entrance of a lens framework, and wherein the lens air duct spans across an adjoining surface between the lamp base and the lens framework.

4. The cooling apparatus as claimed in claim 2, wherein a bottom plate with an air guiding hole is attached on a bottom of the auxiliary air duct the bottom plate guiding air to the air guiding hole, and wherein the external air duct is connected to the air guiding hole and extends form the air guiding hole to near the exit of the lens framework.

5. The cooling apparatus as claimed in claim 2, wherein the light source air duct guides air to the light source inside the lamp base.

6. The cooling apparatus as claimed in claim 1, wherein the fan is an axial fan.

* * * * *